US005465579A

United States Patent [19]

Terada et al.

[11] Patent Number: 5,465,579

[45] Date of Patent: Nov. 14, 1995

[54] GAS COMPRESSION/EXPANSION APPARATUS

[75] Inventors: Fusao Terada, Ota; Takashi Nakazato, Chiyoda; Rikio Tadano, Ogo; Naohide Tanigawa, Oizumi; Tatuya Hirose, Oizumi; Kazuo Ikegami, Oizumi; Kiyoshi Fukushima, Hyogo, all of Japan

[73] Assignee: Sanyo Electric Co., Ltd., Moriguchi, Japan

[21] Appl. No.: 239,415

[22] Filed: May 6, 1994

[30] Foreign Application Priority Data

| | | | |
|---|---|---|---|
| May 12, 1993 | [JP] | Japan | 5-132428 |
| May 14, 1993 | [JP] | Japan | 5-135098 |
| May 14, 1993 | [JP] | Japan | 5-135099 |

[51] Int. Cl.[6] ..... F25B 9/00

[52] U.S. Cl. ..... 62/6; 60/520

[58] Field of Search ..... 62/6; 60/520

[56] References Cited

U.S. PATENT DOCUMENTS

| | | | |
|---|---|---|---|
| 3,971,230 | 7/1976 | Fletcher | 62/6 |
| 4,036,027 | 7/1977 | Bamberg | 62/6 |
| 4,412,423 | 11/1983 | Durenec | 62/6 |
| 4,471,625 | 9/1984 | Yasukochi et al. | 62/6 |
| 4,817,390 | 4/1989 | Suganami et al. | 62/6 |
| 4,907,412 | 3/1990 | Ishibashi et al. | 62/6 |
| 4,969,807 | 11/1990 | Kazumoto et al. | 62/6 |
| 5,113,662 | 5/1992 | Fujil | 62/6 |
| 5,335,506 | 8/1994 | Byoung-Moo | 62/6 |

*Primary Examiner*—Ronald C. Capossela

*Attorney, Agent, or Firm*—Armstrong, Westerman, Hattori, McLeland & Naughton

[57] ABSTRACT

An apparatus for compressing/expanding a working gas (compression/expansion apparatus), including: a cylinder; a piston for compressing/expanding said working gas in a working space (front space) of said cylinder; a crank mechanism connected with a piston rod of said piston via an oil seal; a crank chamber for housing therein said crank mechanism and communicating with said cylinder via said oil seal, said apparatus comprising: a first tube allowing for a unidirectional flow of the working gas from said crank chamber to said front space in said cylinder, said first tube having therein an oil filter and a first check valve; and a second tube allowing for a unidirectional flow of the working gas from said front space to a second space (rear space) behind said piston in said cylinder, said second tube having therein a second check valve. In this construction a loop of the working gas is established for pumping the gas from the crank chamber to the rear space of the cylinder via the front space, and then back to the crank chamber via the oil seal between the cylinder and the crank chamber. The passage of the gas through the oil seal helps prevent the lubrication oil from infiltrating directly from the crank chamber into the cylinder along the piston rod.

9 Claims, 9 Drawing Sheets

GAS COMPRESSION/EXPANSION APPARATUS

FIELD OF THE INVENTION

The invention relates to an apparatus for compressing/expanding gas by means of reciprocating pistons, and more particularly to such apparatuses capable of compressing/expanding gas without causing infiltration of lubrication oil into the gas.

KNOWN ART

In some biotechnological and electronic fields there is a need for refrigeration apparatuses for preserving different materials or test specimens at cryogenic temperature. One candidate for this purpose is an engine known as Stirling's refrigerator, which has two cylinders or engines operating out of phase with each other, one for compression and another for expansion of gas by respective pistons. Since such Stirling refrigerator has a high refrigeration efficiency and seems to be a promising means for cryogenic refrigeration, it is often applied to cryogenic cooling of different kinds of electronic devices such as IR sensors and superconducting devices, and to cryogenic preservation of frozen bio-medical materials.

However, any such apparatus like Stirling refrigerator uses a reciprocating piston which must be driven by a crank mechanism via a piston rod, which piston rod is apt to bring lubrication oil across an oil seal provided between the cylinder and a crank chamber housing the crank mechanism and into the cylinder, 1thereby contaminating the working gas to be compressed or expanded therein. In the case of a Stirling refrigerator, this significantly reduces refrigeration efficiency. For other types of gas compression/expansion apparatuses, there are chances that lubrication oil infiltrating into the cylinder mixes with the gas and results in a hazardous gas.

SUMMARY OF THE INVENTION

The invention is directed to overcome these problems encountered in prior art apparatuses by providing a gas compression/expansion apparatus free of such contamination of the gas by lubrication oil.

Accordingly, in a first aspect of the invention, there is provided an apparatus for compressing/expanding a working gas (compression/expansion apparatus), including: a cylinder; a piston for compressing/expanding said working gas in a working space (front space) of said cylinder; a crank mechanism connected with a piston rod of said piston via an oil seal; a crank chamber for housing therein said crank mechanism and communicating with said cylinder via said oil seal, said apparatus comprising: a first tube allowing for a unidirectional flow of the working gas from said crank chamber to said front space in said cylinder, said first tube having therein an oil filter and a first check valve; and a second tube allowing for a unidirectional flow of she working gas from said front space to a second space (rear space) behind said piston in said cylinder, said second tube having therein a second check valve.

In this construction a loop of the working gas is established for pumping the gas from the crank chamber to the rear space of the cylinder via the front space of the chamber, and then back to the crank chamber via the oil seal between the cylinder and the crank chamber. The passage of the gas through the oil seal helps prevent the lubrication oil from infiltrating directly from the crank chamber into the cylinder along the piston rod.

The second tube is preferably provided with a high pressure gas reservoir adapted to store therein the working gas delivered from the front space via the second check valve and provide the gas to the rear space of the cylinder. Such reservoir may maintain a substantially constant pressure in the rear space of the cylinder, irrespective off the position of the piston in the cylinder, thereby reducing a mechanical load on the piston and resulting in smooth reciprocal motion of the piston. The reservoir is also advantageous in maintaining a steady flow of the gas from the rear space to the chamber.

In a second aspect of the invention, there is provided an apparatus for compressing/expanding a working gas (compression/expansion apparatus), including: a cylinder; a piston for compressing/expanding said working gas in a working space (front space) of said cylinder; a crank mechanism connected with a piston rod of said piston via an oil seal; a crank chamber for housing therein said crank mechanism (and communicating with said cylinder via said oil seal), said apparatus comprising: a partition for dividing a space behind the piston (rear space) in the cylinder into a first section immediately behind the piston and a second section further behind the first section; a first tube allowing for a unidirectional flow of the working gas from the crank chamber to the first section of the rear space, the first tube having therein an oil filter and a first check valve; and a second tube allowing for a unidirectional flow of the working gas from the first section to the second section of the rear space of the cylinder, the second tube having a second check valve provided in the second tube.

The second tube may be further provided with a high-pressure gas reservoir for storing therein the working gas, as in the first aspect above.

In a third aspect of the invention, there is provided apparatus for compressing/expanding a working gas (compression /expansion apparatus), including: a cylinder; a piston in a cylinder driven by a crank mechanism via a piston rod in compressing/expanding the working gas in a working space (front space) of the cylinder; an oil seal provided in a wall separating the cylinder from a crank chamber housing the crank mechanism for sealing the piston rod penetrating the wall, the apparatus comprising: a tube having therein an oil filter and communicating between a space behind the piston (rear space) in the cylinder and the crank chamber, and wherein the oil seal is a magnetic seal.

In this construction, the pressure gradient across the magnetic oil seal is negligibility small, which enhances sealing effect of the magnetic oil seal, so that infiltrating of the lubrication oil from the crank chamber to the cylinder is effectively prevented.

In a fourth aspect of the invention, there is provided an apparatus for compressing/expanding a working gas (compression/expansion apparatus) including: a cylinder; a piston for compressing/expanding said working gas in a working space (front space) of said cylinder; a crank mechanism connected with a piston rod of said piston, said apparatus comprising: a diaphragm provided in said cylinder for hermetically separating a space behind said piston in said cylinder (rear space) into a first section adjacent to said piston and a second section (crank chamber) accommodating said crank mechanism; and a tube having therein an oil filter, said tube communicating between said first section and said crank chamber.

In this construction, the diaphragm secured on the piston rod and on the inner wall of the cylinder provide completely separates the cylinder chamber from the crank chamber, so that the lubrication oil is also sealed completely across the piston rod.

In a fifth aspect of the invention, there is provided an apparatus for compressing/expanding a working gas (compression/expansion apparatus), including: a cylinder; a piston for compressing/expanding said working gas in a working space (front space) of said cylinder; a crank mechanism connected with a piston rod of said piston via an oil seal; a crank chamber for housing therein said crank mechanism and communicating with said cylinder via said oil seal, said apparatus comprising: a cross guide formed at one end of the piston rod remote from the piston, and pivotally connected with a connecting rod of the crank mechanism for converting rotational motion of the crank mechanism into linear reciprocal motion of the piston; a recessed guide formed in the crank chamber for supporting and guiding the cross guide in linear motion, the recessed guide having a bore through which the piston rod penetrates; and an oil repellent member formed at a terminal end of the recessed guide for preventing accumulation of lubrication oil thereon.

in this construction, no appreciable infiltration of oil from the terminal end of the recessed guide into the cylinder along the piston rod passing through the bore takes place, since lubrication oil is prohibited to accumulate on the terminal end of the recessed guide due to the oil repellent member.

In a sixth aspect of the invention, there is provided an apparatus for compressing/expanding a working gas (compression/expansion apparatus), including: a cylinder; a piston for compressing/expanding said working gas in a working space (front space) of said cylinder; a crank mechanism connected with a piston rod of said piston via an oil seal; a crank chamber for housing therein said crank mechanism and communicating with said cylinder via said oil seal, said apparatus comprising: a cross guide formed at one end the piston rod remote from the piston, and pivotally connected with a connecting rod of the crank mechanism for converting rotational motion of the crank mechanism into linear reciprocal motion of the piston; a recessed guide formed in the crank chamber for supporting and guiding the cross guide in linear motion, the recessed guide having a bore through which the piston rod penetrates; and a groove for returning lubrication oil accumulated in the recessed guide, the groove formed in the recessed guide and having a depth increasing from a terminal end to an open end of the recessed guide.

In this construction, the lubrication oil that can accumulate on the internal surfaces of the recessed guide and the cross guide may be effectively removed by the groove, preventing infiltration of the oil into the cylinder chamber.

It is also preferable to provide an oil repellent member on the terminal end of the recessed guide of this apparatus through which the piston rod penetrates, thereby preventing by the oil repellent member the infiltration of the lubrication oil from the terminal end into the cylinder chamber along the piston rod.

DETAILED DESCRIPTION OF THE PREFERRED EMBODIMENT

Figure 1:
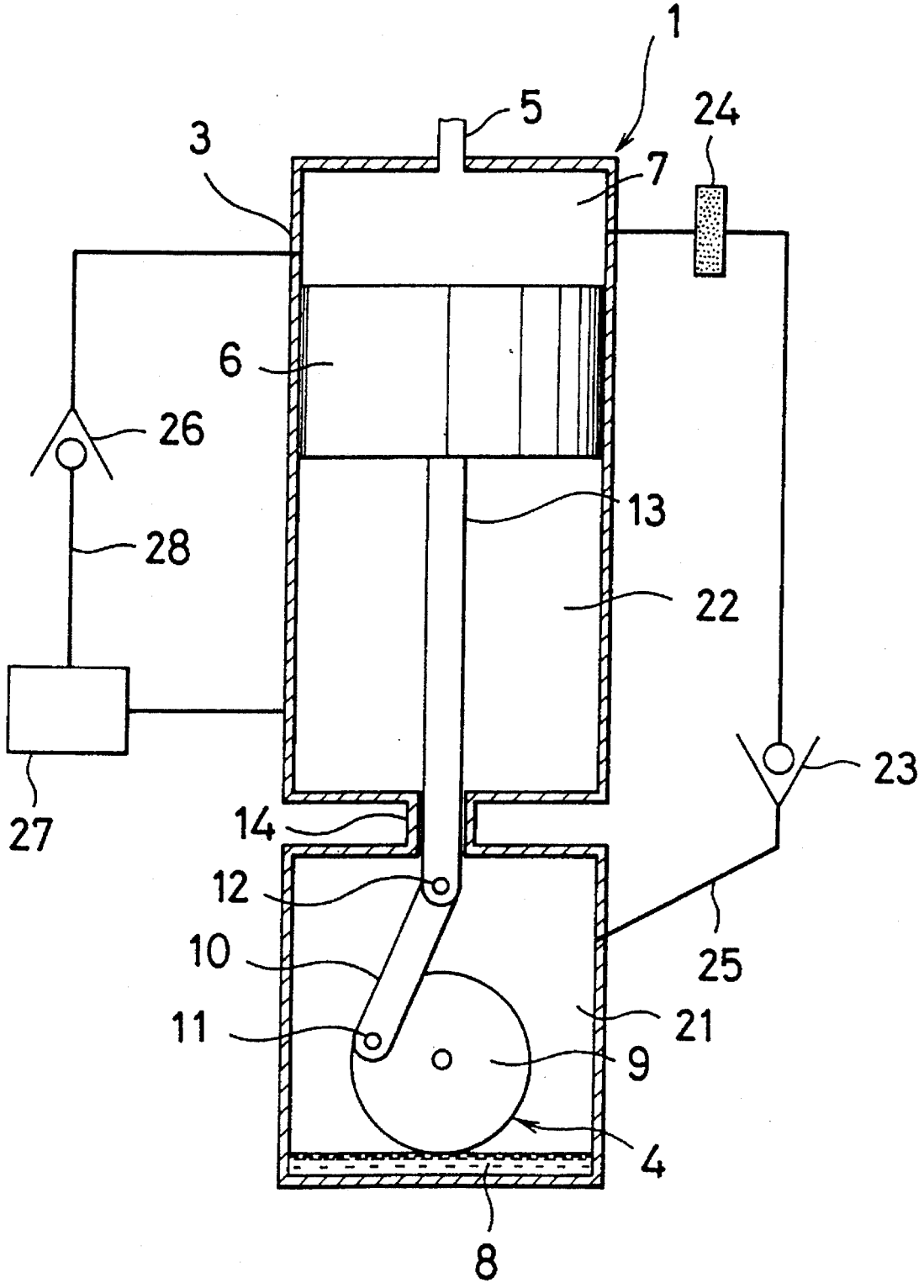
FIG. 1 is a cross sectional view of a first gas compression/expansion apparatus of the invention, having a cylinder connected with a crank chamber via an oil seal through which a piston rod passes.

FIG. 1 is a cross section of a gas compression/expansion apparatus of the invention. As seen in the figure, the gas compression/expansion apparatus 1 includes an upper cylinder chamber 3 and a lower crank chamber 21 connected with the cylinder chamber 3 via an oil seal 14. Penetrating through the oil seal 14 is a piston rod 13 of a piston 6. Inside the crank chamber 21 is a crank mechanism 4 having a connecting rod 10 connected with the piston rod 13 for driving the piston 6 up and down to compress/expanded a working gas in an upper section (front space) of the cylinder chamber 3.

The crank chamber 21 also accommodates lubrication oil 8 at the bottom of the chamber 21. A drive motor (not shown) may drive a disc crank 9 for rotation about a shaft. The disc crank 9 has a pin 11 on which a connecting rod 10 is pivoted at one end thereof for reciprocal motion of a piston rod 13 which is pivoted at the other end of the connection rod 10.

The cylinder chamber 3 is partitioned by the piston 6 into an upper working portion 7 (hereinafter referred to as front space) for accommodating the working gas to be compressed/expanded, and a Lower portion 22 (hereinafter referred to as rear space). The front space is provided with an inlet/outlet port 5, through which the working gas to be compressed/expanded is introduced into and discharged from the front space 7.

The crank chamber 21 is connected with the front space 7 by a first communication tube 25, which includes a first check valve 23 for allowing unidirectional passage of the gas from the crank chamber 21 to the front space 7, and an oil filter 24 for removing the lubrication oil diffused in the gas. The front space 7 is also connected with the rear space 22 of the cylinder chamber 3 by a second communication tube 28. The communication tube 28 also includes a second check valve 26 and a high-pressure gas reservoir 27. The check valve 26 permits a unidirectional gas flow from the front space 7 to the high-pressure gas reservoir 27.

Although the oil filter 24 is provided downstream of the first check valve 23, it may be provided upstream of the check valve 23.

In this construction, rotational motion of the disc crank 9 caused by a drive motor is converted to vertical reciprocal motion of the piston rod 13 in the cylinder chamber 3 via the motion of the connecting rod 10, thereby compressing or expanding the working gas trapped in the front space 7.

The pressure of the gas in the front space 7 becomes lower than that of the gas in the rear space 22 as the piston 6 is driven downward, causing the gas in the crank chamber 21 to flow therefrom to the front space 7 through the communication tube 25. As mentioned previously, the gas is permitted by the check valve 23 to flow only in one direction, and the lubrication oil 8 is removed by the oil filter 24 before it enters the front space 7. It should be noted that in spite of a pressure difference between the front space 7 and the rear space 22 the gas cannot flow from the rear space 22 to the front space 7 due to the check valve 26.

On the other hand, when the piston 6 is driven upward, the pressure in the front space 7 increases. As the pressure reaches a predetermined level, the check valve 23 stops the gas flow through the communication tube 25 from the crank chamber 21 to the front space 7, and at the same time permitting the check valve 26 to pass the gas from the front space 7 into the high-pressure gas reservoir 27 providing the rear space 22 with the gas to maintain therein a substantially constant pressure at all times. The predetermined level of the pressure in the high-pressure gas reservoir is set such that the pressure in the rear space 22 is always slightly higher than the pressure in the front space 7, and hence in the crank chamber 21. This pressure gradient allows a slight gas flow from the rear space 22 into the crank chamber 21 via the oil seal 14, preventing infiltration of lubrication oil 8 from the crank chamber 21 into the rear space 22.

It should be appreciated that the gas in the rear space 22 is regulated by the high-pressure gas reservoir so as to maintain a substantially constant pressure irrespective of the reciprocal motion of the piston 6, so that the change in load on the piston 6 is minimized. This is advantageous for stable operation of the piston and a steady flow from the rear space 22 to the crank chamber 21 via the oil seal 14.

It should be noted, however, that the high-pressure gas reservoir may be not necessary if the volume of the communication tube 28 is sufficiently large to serve as a gas reservoir.

Figure 2:
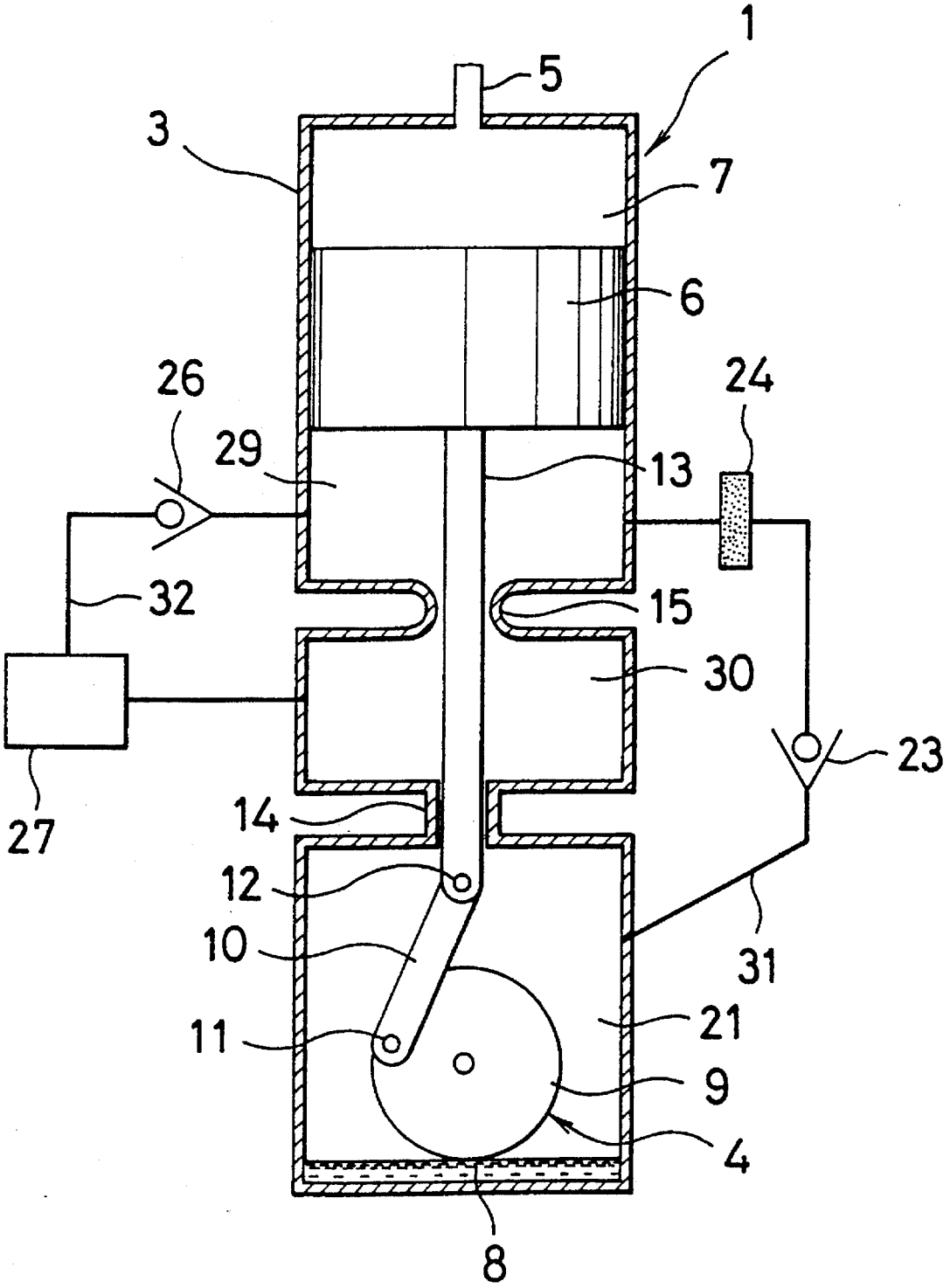
FIG. 2 a cross sectional view of a second gas compression/expansion apparatus of the invention, having an additional space connected with a cylinder via a first oil seal, and connected with a crank chamber via a second oil seal, through which oil seals a piston rod passes.

Referring now to FIG. 2, there is shown a second example of the invention, in which like or corresponding components are referred to by the same numbers as in FIG. 1. This example differs from the first example of FIG. 1 in that the rear space 22 of FIG. 1 is divided by an oil seal 15 into a first space 29 and a second space 30 which is connected with the space 29. The second space 30 is further connected to a crank chamber 21 via a seal 14. The crank chamber 21 is now connected with the first space 29 by a first communication tube 31. The first space 29 is in turn connected with the space 30 by a second communication tube 32. As in the first example, these communication tubes include respective unidirectional check valves 23 and 26. The communication tube 31 further includes an oil filter 24 for removing lubrication oil from the gas in the communication tube 31, while the communication tube 32 includes a high-pressure gas reservoir for maintaining the pressure in the space 30 at the same level as the high-pressure gas reservoir 27. The oil filter 24 may be provided upstream, instead of downstream, of the check valve 23.

In this construction, when a disc crank 9 is rotated by a drive motor, its rotational motion is converted into vertical reciprocal motion of a piston rod 13 of the piston 6 by means of a connecting rod 10 pivoted at one end on a pin 11 on the disc crank 9 and at the opposite end on a pin 12 of the piston rod 13, thereby compressing or expanding the gas trapped in the front space 7, in the same manner as in the first example described above.

When the piston 6 is driven upward (to compress the gas in the front space 7 or discharge the gas from the front space 7), the gas in the first space 29 is expanded, so that the gas pressure therein becomes lower than the pressure in the crank chamber 21 and the second space 30, causing the gas in the crank chamber 21 to flow from the crank chamber 21 to the first space 29 through the communication lube 31. The oil filter 24 will filter the lubrication oil 8 diffused into the communication tube 31, allowing only the working gas to enter the first space 29. Because of the check valve 26, the gas is not allowed to pass through the check valve 26 if the pressure in the first space 29 is lower than the pressure in the communication tube 32. It should be noted then that the pressure in the second space 30 is higher than in the crank chamber 21 due to the gas reservoir 27, so that the gas flows from the second space 39 to the crank chamber 21 through the oil seal 14, preventing the infiltration of the lubrication oil 8 into the space 30 via the oil seal 14.

When the piston 6 is driven downward for expansion or suction of the gas in the front space 7, the gas in the first space 29 is compressed and reaches a pressure higher than the gases in the crank chamber 21 and the space 30. This causes the check valve 23 to shut the gas flow therethrough, and causes the gas to flow from the first space 29 into the high-pressure gas reservoir 27. Again a small part of the gas in the second space 30 flows from space to the crank chamber 21 via the oil seal 14, thereby preventing the infiltration of the lubrication oil 8 from the crank chamber 21 to the second space 30.

Consequently, a circulatory loop off gas is established, pumping the working gas from the crank chamber 21 into the space 29 and returning a part of the gas from the space 30 to the crank chamber 21 via the oil seal 14, with the pressure in the space 30 kept at a higher pressure level than in the crank chamber 21. The unidirectional flow of the gas via the oil seal 14 thus prevents the infiltration of the lubrication oil from the crank chamber 21 into the space 30 through the oil seal 14 at all times.

It should be noted that in the second example described above the compression or expansion of the gas by the piston 6 may be carried out without the fear off infiltration of the lubrication oil due to the fact that the circulation loop of the gas through the crank chamber 21, space 29 and space 30 is independent of the front space 7 where the compression or expansion of the gas is carried out.

In the second example, the high-pressure gas reservoir may be deleted to make the apparatus compact if the inner volume of the tube communication tube 32 is sufficiently large.

Figure 3:
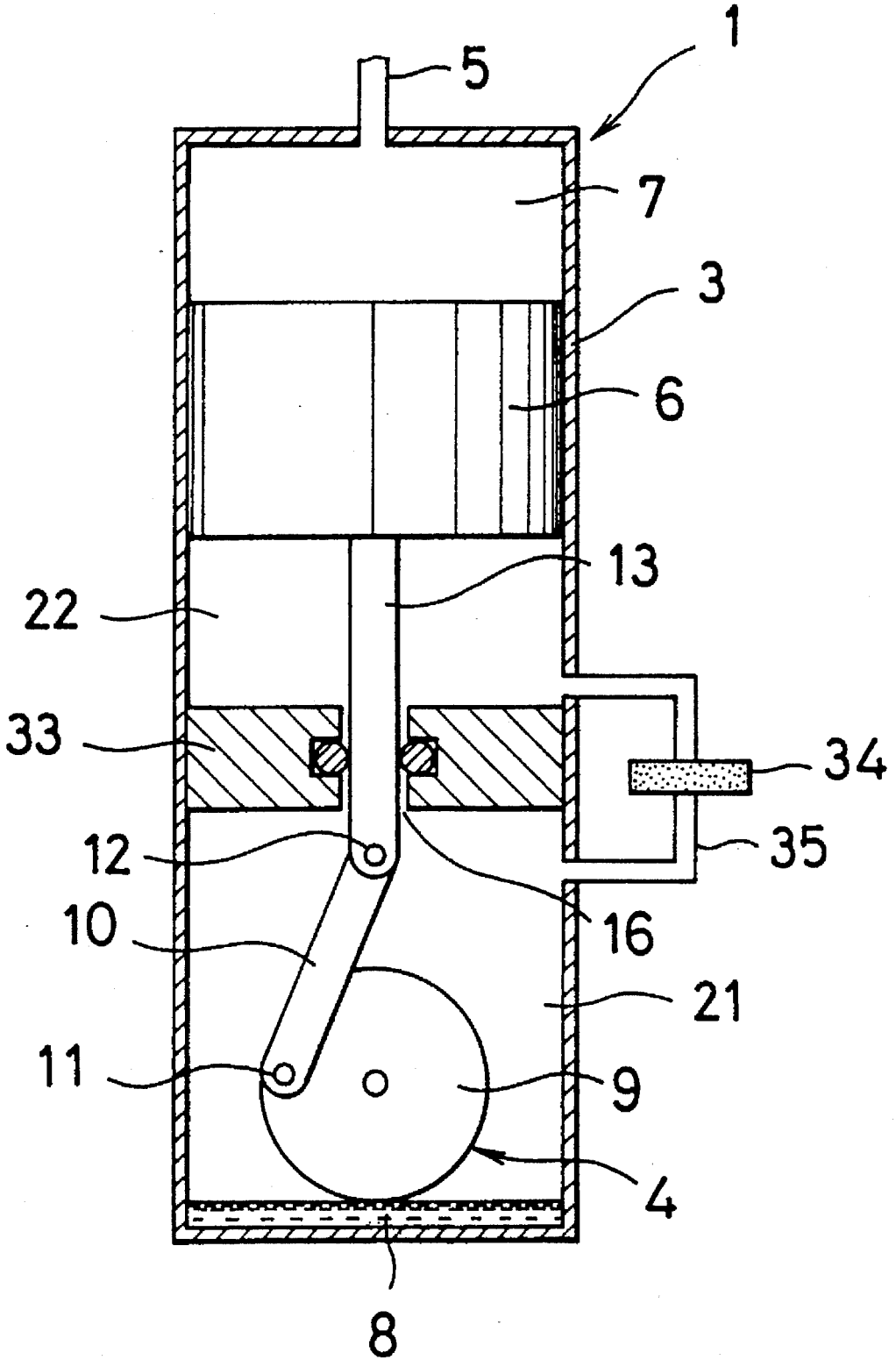
FIG. 3 is a cross sectional view of a third gas compression/expansion apparatus of the invention, having a cylinder connected with a crank chamber via a magnetic-oil seal through which a piston rod passes.

Referring now to FIG. 3, there is shown a third apparatus of the invention, in which like or corresponding components are numbered the same as in FIG. 1. The apparatus shown in FIG. 3 differs from the one shown in FIG. 1 in that instead of the oil seal 14 a magnetic fluid seal 33 is disposed between a rear space 22 and a crank chamber 21, and that a single connection tube 35 having therein an oil filter now substitutes for the two communication tubes 25 and 28 off

FIG. 1.

Figure 4:
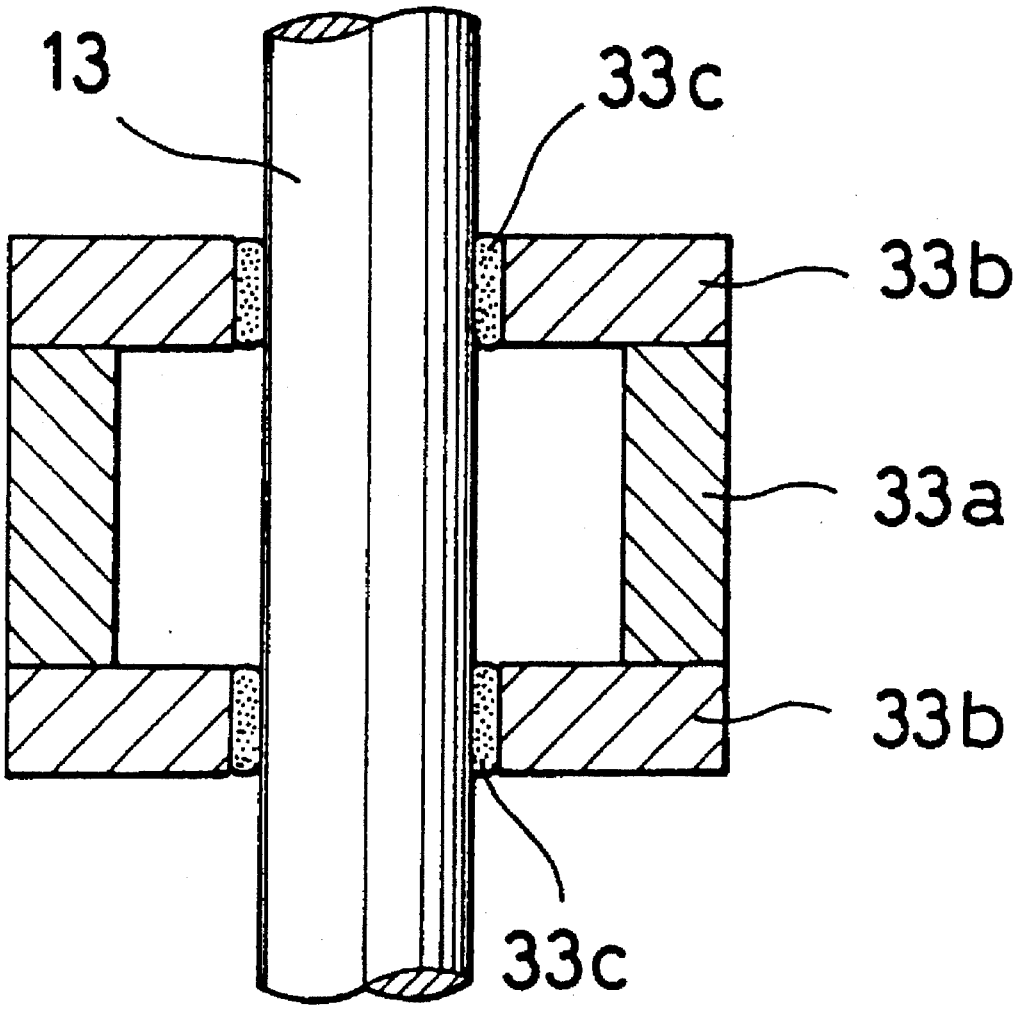
FIG. 4 is an enlarged sectional view of the magnetic oil seal of FIG. 3.

As shown in detail in FIG. 4, the magnetic fluid seal 33 comprises a cylindrical magnet 33*a* surrounding the piston rod 13, thick magnetic members 33*b* having approximately the same inner diameter as the outer diameter of the piston rod 13 and joined to the upper and lower ends of the magnet 33*a*, and a magnetic fluid 33*c* disposed between the magnetic members 33*b* and the piston rod 13.

Magnetically combined with the piston rod 13, the cylindrical magnet 33*a*, upper and lower magnetic members 33*b*, and upper and lower magnetic fluids 33*c* altogether constitutes a magnetic loop, holding the magnetic fluids 33*c* in position in between the piston rod 13 and the magnetic member 33*b* and hermetically filling the gap between them and thereby preventing the infiltration of the lubrication oil into the cylinder without disturbing the motion of the piston rod 13.

In this construction, when a disc crank 9 is rotated by a drive motor, its rotational motion is converted into vertical reciprocal motion of a piston rod 13 of the piston 6 by means of a connecting rod 10 pivoted at one end on a pin 11 on the disc crank 9 and at the opposite end on a pin 12 of the piston rod 13 at its opposite ends, thereby compressing or expanding the gas in the front space 7, in the same manner as in the first example described above.

During the operation of the piston, the gas in the rear space 22 is subject to compression and expansion. However, since the rear space 22 and the crank chamber 21 are connected by the connection tube 35, pressures in the rear space 22 and the crank chamber do not differ very much, so that there is only a small pressure gradient across the magnetic fluid 33*c*. Thus, an appropriate magnet 33*a* may be used for holding the sealant 33*c* in position.

When the piston 6 is driven downward, a corresponding amount of the gas in the rear space 22 is driven out of the rear space 22 into the crank chamber 21 via the connection tube, and vise versa when the piston 6 is driven upward. This minimizes the pressure difference between the crank chamber 21 and the rear space 22, thereby holding the magnetic sealant 33*c* in the gaps and enhancing sealing effect off the magnetic fluid seal 33. Thus, the magnetic seal 33 may prevent the infiltration of the lubrication oil into the rear space 22 along the piston rod 13. It should be appreciated that the lubrication oil contained in the gas flowing from the crank chamber 21 to the rear space 22 is removed by the filter 34 before the gas enters the rear space 22.

Figure 5:
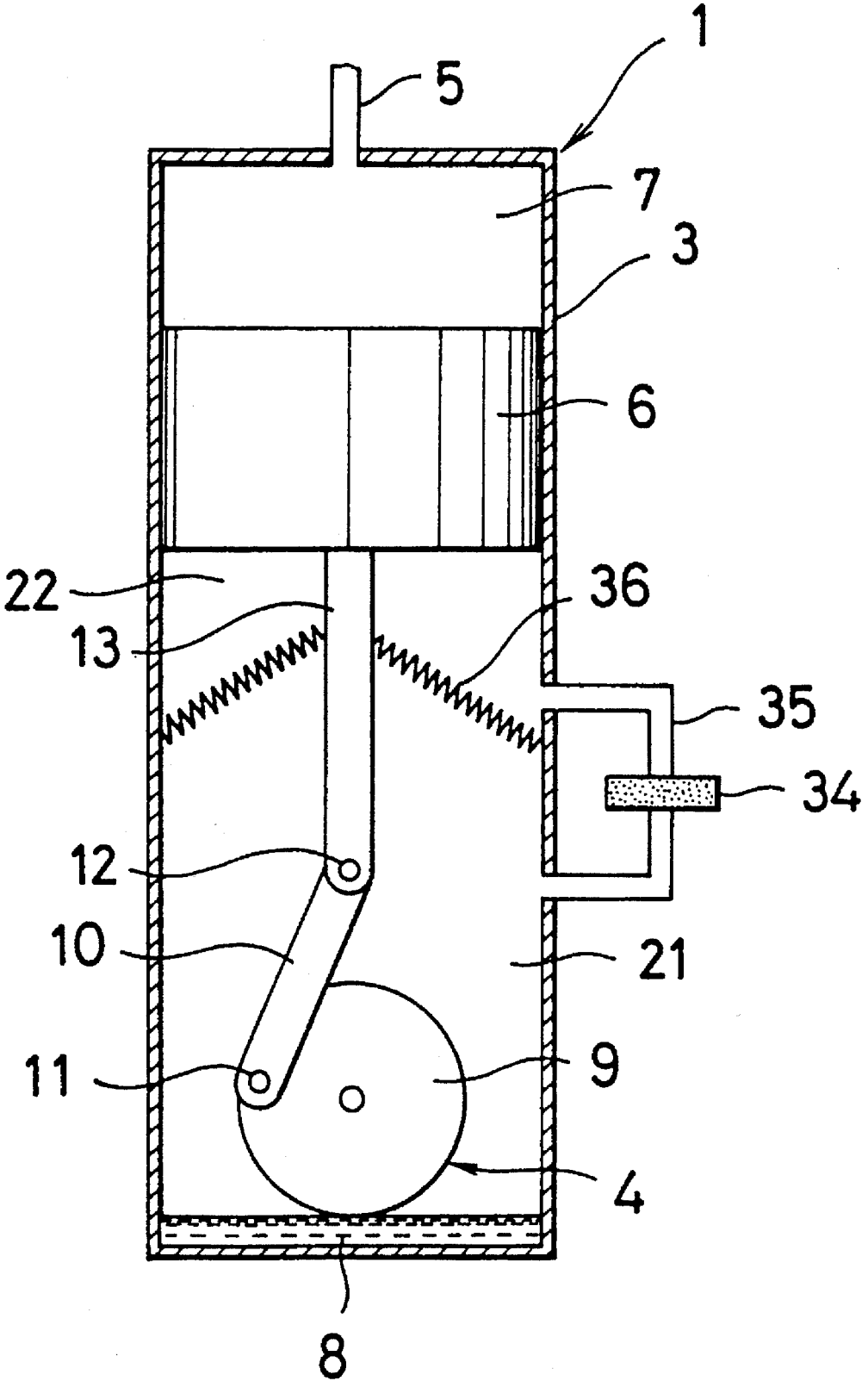
FIG. 5 is a cross sectional view of a fourth gas compression/expansion apparatus of the invention, having a diaphragm mounted on a piston rod for separating a cylinder and a crank chamber.

Referring now to FIG. 5, there is shown a fourth example of the invention, in which like or corresponding components are numbered the same as in FIG. 3. The apparatus of FIG. 5 differs from the third one shown in FIG. 3 in that instead of the magnetic seal 33 a diaphragm 36 is used for separating a rear space 22 from a crank chamber 21. The diaphragm 36 is mounted at its periphery on the inner wall of the cylinder 3 and at its central hole on a piston rod 13.

Such diaphragm 36 may completely shut the lubrication oil out of the rear space 22 and prevent the infiltration of the oil into the rear space 22. The diaphragm 36 is moved up and down with the piston rod 13. If there were a large pressure difference between the crank chamber 21 and the rear space 22, the gas would prevent the smooth motion of the diaphragm, and in the worst event rupture the diaphragm. In the example shown in FIG. 5, however, the connection tube allows instantaneous adjustment of such pressure difference between them if any, thereby equilibrating the pressures on both sides of the diaphragm, i.e. minimizing the net pressure acting on the diaphragm 36 and preventing its rupture. Further, as mentioned earlier, since the lubrication oil is removed from the gas before the gas transported from the crank chamber 21 enters the rear space 22, a highly reliable gas compression/expansion apparatus may be provided by the invention without any infiltration of the lubrication oil into the working gas.

Figure 6:
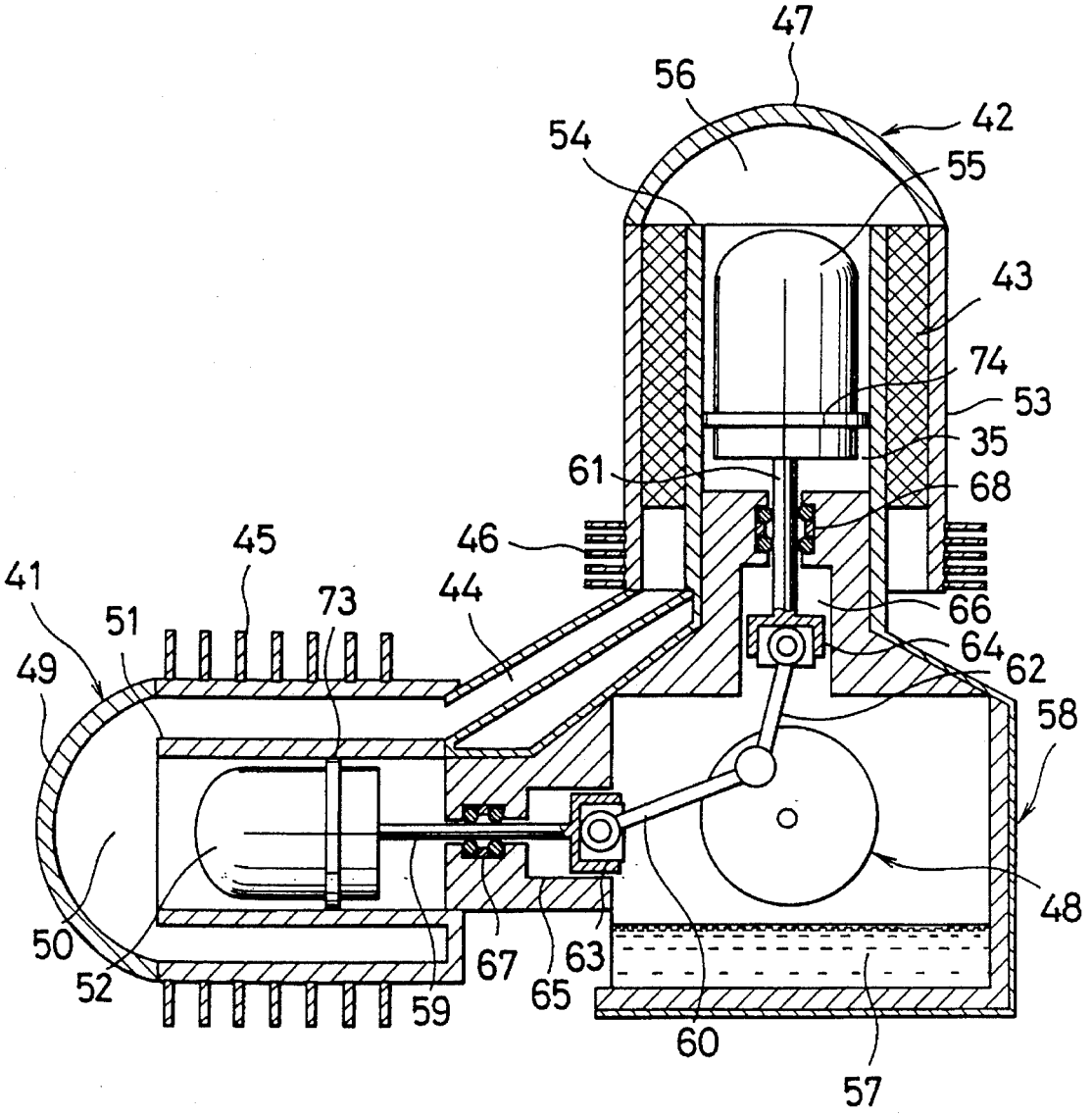
FIG. 6 is a cross sectional view of a fifth gas compression/expansion apparatus of the invention for use in refrigeration, showing how a crank mechanism operates to compress and expand a gas in two cylinders in cooling the gas.

Referring to FIG. 6, there is shown a fifth example of the invention in the form of Stirling refrigerator, which includes a gas compression engine 41 and a gas expansion engine 42 which operate out of phase with each other. The refrigerator also includes a gas pipe 44 connecting the two engines and having therein a regenerator 43, a heat radiator 45 provided at one end of the gas pipe 44 closer to the engine 41, and another heat radiator 46 provided at the entrance of the regenerator 43. Provided at the rear of the gas compression engine 41 and below the gas expansion engine 42 is a crank mechanism 48 for driving the engines 41 and 42.

The gas compression engine 41 has a shell 49 to form a compression space 50 between the shell 49 and the gas compression engine 41, where the gas trapped therein may be compressed in a cylinder 51 by a reciprocal piston 52 of the engine 41 during compression mode of the refrigerator in accordance with a predetermined cycle, providing the compressed gas to the gas expansion engine 42 which is operating in expansion mode. A suitable working gas for cryogenic cooling is helium. The piston 52 is driven by the crank mechanism 48 in a manner as described in detail later.

The gas expansion engine 42 also has a shell 53 and a top cover 47 covering the shell 53 to form a space 56 beneath the top cover 47 and above a cylinder 54 of the gas expansion engine 42, where the gas supplied from the gas compression engine 41 and trapped therein is allowed to expand as a piston 55 of the gas expansion engine 42 is driven downward. As a result of adiabatic expansion in the space 56, the gas is cooled. After repeated expansion, the gas will be eventually cooled to a cryogenic temperature.

The regenerator 43 may be a cylinder or sphere in shape and made of a porous material such as a mesh made of a metal having a large specific heat, e.g. copper, stainless steel, and lead. Such porous material may be fabricated from a blank material by uniformly forming therein numerous holes by any known method. Uniform distribution of such holes helps to maximize heat exchange between the regenerator 43 and the gas passing through it. The regenerator 43 thus formed is disposed within a space between the shell 53 and outer wall of the cylinder 54, so as to cool the compressed gas delivered :from the gas compression engine 41 through the gas pipe 44. The cooled gas is then passed to the gas expansion engine 42. The regenerator 43 is cooled by the gas which experienced expansion in the space 56 and returns to the gas compression engine 41.

The gas pipe 44 is in communication with the gas compression engine 41 and gas expansion engine 42. The heat radiator 45 and 46 serve to cool the compressed hot gas by radiating heat therefrom. For this purpose, the heat radiator 45 consists of a multiplicity of annular fins provided on the outer surface of the 49, while the heat radiator 46 consists of a multiplicity of annular fins provided on the outer surface of the shell 53. The top cover 47 may be made of a stainless steel, for example, and serves as a source of negative heat. A "source of negative heat" (referred to also as negative heat source) implies here a body which may absorb heat from an object. As such, the top cover 47 may provide negative heat to a low-temperature heat reservoir (not shown) for cryogenic refrigeration of an object.

A crank mechanism 48 housed in a crank chamber 58 is provided for driving the pistons 52 and 55 which are out of phase such that the piston 52 is in compression mode when the piston 55 is in expansion mode. The crank chamber 58 also accommodates lubrication oil 57. The piston 52 is connected with the crank mechanism 48 via a piston rod 59 and a connecting rod 60. Similarly, the piston 55 is connected with the crank mechanism 48 via a piston rod 61 and a connecting rod 62.

In order to convert rotational motion of the crank mechanism 48 to a linear motion of the pistons 52 and 55, one end of each of the connecting rods 60 and 62 is pivoted on a shaft protruding from the periphery of a disc crank, and the other end of each of the rods 60 and 62 is pivoted on respective shafts on respective cross guides 63 and 64.

The crank chamber 58 has recessed portions 65 and 66 for guiding the cross guides 63 and 64 during their reciprocal motions. The cylinder 51 is separated from the crank chamber 58 by a wall having a piston rod bore through which the piston rod 59 penetrates for reciprocal motion. The piston rod bore is sealed by an oil seal 67. Similarly, the cylinder 54 is separated from the crank chamber 58 by another wall having a piston rod bore through which the piston rod 61 penetrates for its reciprocal motion. The piston rod bore is also provided with an oil seal 68.

Figure 7:
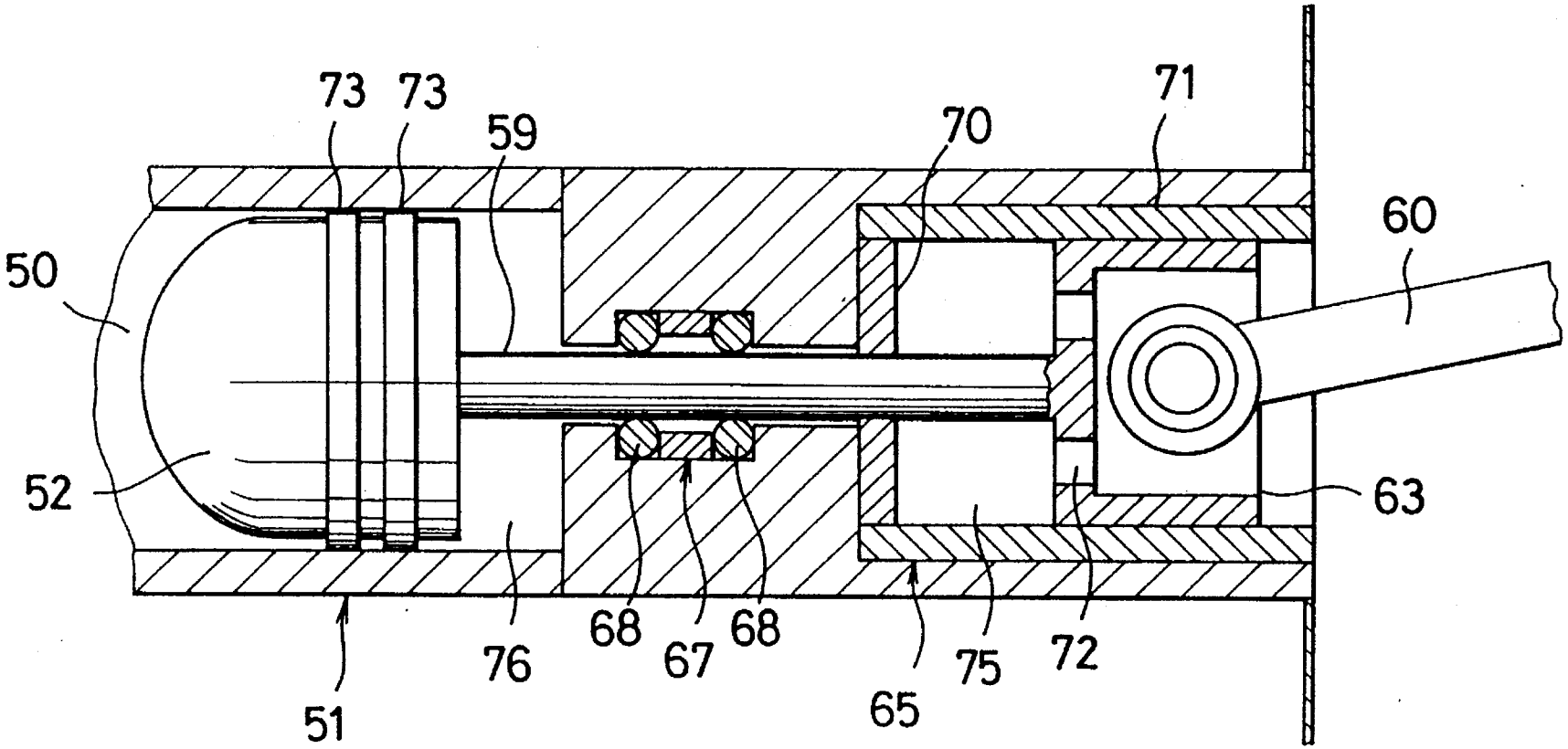
FIG. 7 is a detailed partial sectional view of one type of the cylinders of the compression/expansion apparatus of FIG. 6.

FIG. 7 is a detailed partial cross sectional view of the piston 52, in which the guide 65 fabricated in the form of a cylindrical recess is provided For holding therein the cross guide 63 and guiding it for its smooth reciprocal motion. Formed at one end of the recessed portion 65 is a bore communicating with the oil seal 67. The piston rod 59 may reciprocate through the bore. The oil seal 67 includes a spacer 67 and two oil seal members 68 on the opposite ends of the spacer 67. Formed at the opposite end of the recessed portion 65 is an oil repellent member 70, which may be a thin film of an oil repellent material such as Teflon (fluorocarbon polymers) plated or coated on a relevant portion of the recessed portion 65. Preferably, the inner surface of the recessed portion 65 is also covered with a similar oil repellent member 71. Formed in the opposite end of the cross guide 63 with which the piston rod 59 is connected is a gas passage 72 for allowing gas captured in the guide to escape therefrom. Also, mounted on the piston 52 are piston seals 73 for shutting the working gas off a space 76 behind the piston 52.

In this construction, the crank mechanism 48 actuated by a motor (not shown) drives the piston 52 off the gas compression engine 41 forward, i.e. towards the compression space, compressing the working gas such as helium in the compression space 50. Then the compressed gas will be allowed to flow from the compression space 50 to the regenerator 43 via the gas pipe 44. It should be noted again that while passing through the gas pipe 44 the gas is cooled by heat radiation from the heat radiator 45 and 46 mounted on the outer surface of the shell 49 and 53, respectively.

The gas is further cooled as it passes through the heat exchange members such as metal meshes in the regenerator 43. The cooled gas is then accumulated in the space 56 of the gas expansion engine 42 to a relatively high pressure.

Following this accumulation off the gas, the piston 55 of the expansion engine 42 is driven downward in the cylinder 54 about 90° behind in phase with respect to the piston 52. Consequently, the gas is adiabatically expanded in the space 56, lowering its temperature.

Subsequent to the last mentioned expansion, the crank mechanism brings the piston 55 to its upper position and at the same time withdraws the compression piston 52 backward, allowing the cooled working gas to return From the expansion space 56 to the compression space via the regenerator 43 and the gas pipe 44. Note that the regenerator 43 is cooled by the expanded gas in this step. This completes a thermal cycle of the refrigerator.

By repeating the cycle as described above, the gas and the regenerator 43 may be cooled continually, bringing the gas to a cryogenic temperature. Thus, negative temperature may be provided from the top cover 47 to refrigerate an object in a refrigeration chamber (not shogun).

Thus, the gas compression/expansion apparatus of the invention herein described may provide negative heat from the top cover 47 by repetitively transporting the working gas between the gas compression engine 41 and the gas expansion engine 42.

Should the lubrication oil infiltrate into the crank chamber 58, the regenerator 43 might suffer from clogging of oil. If the oil deposits on the internal surface of the top cover 47 forming a thin film of the oil, then the negative heat source 47 will suffer from poor heat conduction. In order to prevent such adversities, the apparatus of the invention is provided with the gas passages 72 through the cross guides 63 and oil repellent member 70 on the terminal end of the recessed guides 65.

Such passages may prevent the infiltration of the lubrication oil from the crank chamber 58 into the cylinder by discharging the gas trapped in a space 75 between the recessed portion 65 and the cross guide 53 through the passages, making the pressure of the gas therein always the same as the pressure in the crank chamber 58, which is very low in the crank chamber 58. Thus, it is possible to maintain the pressure in the space 75 at a level below the pressure in the space 76 behind the piston seal 73, thereby preventing the infiltration of the lubrication oil into the piston 52. The oil repellent film formed on the terminal end of the recessed portion 65 helps prevent deposition oil thereon, reducing the amount of oil that can be induced into the piston rod bore by the piston rod 59. Lubrication oil carried into the piston rod bore is completely removed by the oil seal 67. Thus, infiltration of the lubrication oil from the crank chamber 58 is perfectly prevented.

Figure 8:
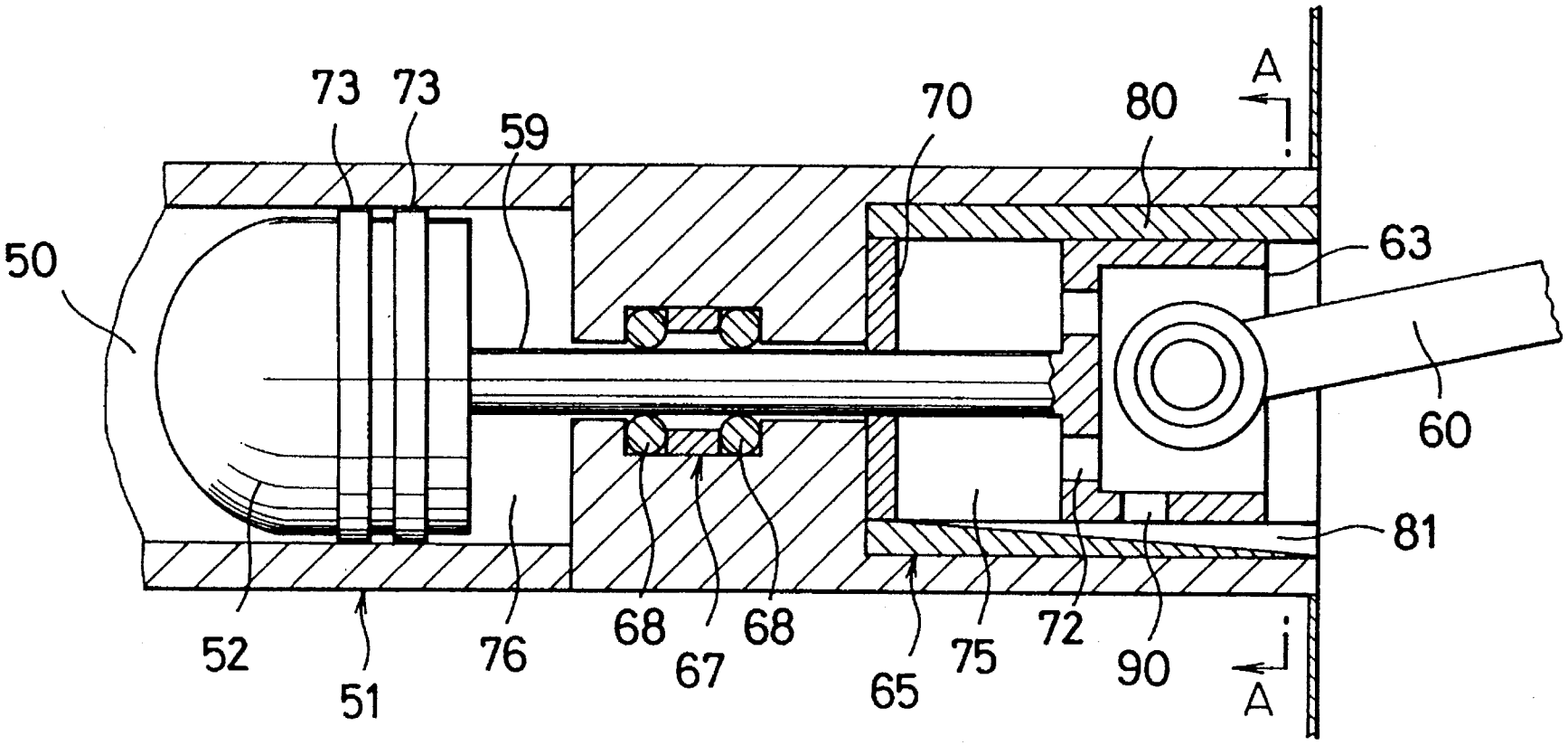
FIG. 8 is a detailed partial sectional view of another type of the cylinders of the compression/expansion apparatus of FIG. 6.
Figure 9:
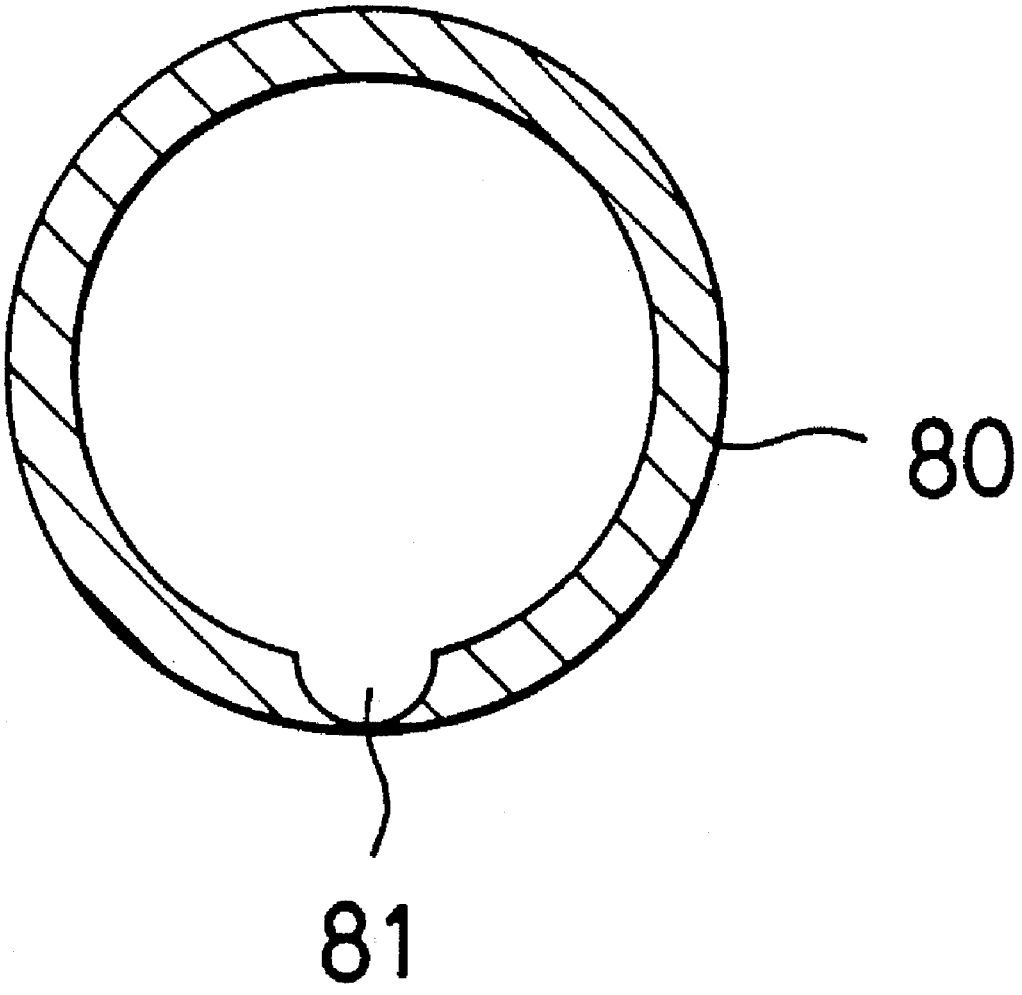
FIG. 9 is a cross section of a cross guide receiving cylinder taken along the line A—A of FIG. 8.

FIG. 8 is a partial cross section off a compression cylinder for use in a sixth example of the invention, in which like or corresponding components are numbered the same as in FIGS. 6 and 7. Differences between this and the foregoing examples are that this example has: (1) a groove 81 formed in a cross guide receiver 80 in a cross guide 63 which has an increasing depth towards a crank chamber; (2) a further hole 90 in the cross guide 63 facing the groove 81.

Although an oil repellent member 70 is shown in the figure, it is not inevitable in this example.

Features and operational characteristics of this example are basically the same as those of the fifth example. That is, compression and expansion of a working gas is carried out by a crank mechanism 48, providing negative heat; infiltration of the lubrication oil into the piston 52 due to pressure difference between two space 75 and 76 may be prevented by gas passages 72 formed in the cross guide 63; accumulation of the lubrication oil on the terminal end of the recessed portion 65, hence induction of the oil into the piston rod bore, is prevented by the oil repellent member 70; and the oil carried by the piston rod in the piston rod bore is completely removed by the oil seal 67. In addition, this example has a feature that the lubrication oil accumulated in the space 75 may be removed easily through an oil return groove 81 formed in the cross guide receiver 80, thereby further preventing the infiltration of the oil into the cylinder.

It should be understood than although the invention is described by way of example for only the compression engines 41 in the fifth and sixth examples, the expansion engines 42 have essentially the same features and characteristics as the compression engines 41.

What we claim is:

1. An apparatus for compressing/expanding a working gas including: a cylinder having a working space; a piston for compressing/expanding said working gas in said working space of said cylinder; a piston rod connected to said piston; a crank mechanism operatively connected to said piston rod for driving said piston; a crank chamber housing therein said crank mechanism and a body of lubricating oil for lubricating said crank mechanism; and an oil seal defining a passage for said piston rod and having one end communicating with said crank chamber and its other end communicating with said cylinder, said apparatus comprising:

a first tube having a first check valve for effecting a unidirectional flow of the working gas from said crank chamber to said working space in said cylinder, an oil filter in said first tube; and a second tube having a second check valve for a unidirectional flow of the working gas from said working space behind said piston in said cylinder for establishing a higher gas pressure on the cylinder end of said oil seal than on the crank chamber end thereof to prevent the passage of lubricating oil from said crank chamber to said cylinder.

2. An apparatus as claimed in claim 1, wherein said second tube is further provided with a high-pressure gas reservoir for storing therein said working gas.

3. An apparatus for compressing/expanding a working gas including: a cylinder having a working space; a piston for compressing/expanding said working gas in said working space of said cylinder; a piston rod connected to said piston; a crank mechanism operatively connected to said piston rod for driving said piston; a crank chamber housing therein said crank mechanism and a body of lubricating oil for lubricating said crank mechanism; and an oil seal defining a passage for said piston rod and having one end communicating with said crank chamber and its other end communicating with said cylinder, said apparatus comprising:

a partition for dividing said space behind said piston in said cylinder into a first section immediately behind said piston and a second section further behind said first section;

a first tube having a first check valve for effecting a unidirectional flow of said working gas from said crank chamber to said first section, and oil filter in said first tube; and a second tube having a second check valve for effecting a unidirectional flow of said working gas from said first section to said second section of said cylinder for establishing a greater fluid pressure on the cylinder end of said oil seal than on the crank chamber end thereof and preventing the passage of lubricating oil from said crank chamber to said cylinder.

4. An apparatus as claimed in claim 3, wherein said second tube is provided with a high-pressure gas reservoir for storing therein said working gas.

5. An apparatus for compressing/expanding a working gas including: a cylinder having a working space; a piston for compressing/expanding said working gas in said working space of said cylinder; a piston rod connected to said piston; a crank mechanism operatively connected to said piston rod for driving said piston; a crank chamber housing therein said crank mechanism and a body of lubricating oil for lubricating said crank mechanism; and an oil seal defining a passage for said piston rod and having one end communicating with said crank chamber and its other end communicating with said cylinder, said apparatus comprising:

a tube having therein an oil filter and communicating between a space behind said piston in said cylinder and said crank chamber, and wherein said oil seal is a magnetic seal.

6. An apparatus for compressing/expanding a working gas including: a cylinder having a working space; a piston for compressing/expanding said working gas in said working space of said cylinder; a piston rod connected to said piston; a crank mechanism operatively connected to said piston rod for driving said piston, said apparatus comprising:

a diaphragm provided in said cylinder for hermetically separating said working space behind said piston in said cylinder into a first section adjacent to said piston and a second section defining a crank chamber accommodating said crank mechanism; and a tube having therein an oil filter, said tube communicating between said first section and said crank member.

7. An apparatus for compressing/expanding a working gas (compression/expansion apparatus), including: a cylinder; a piston for compressing/expanding said working gas in a working space (front space) of said cylinder; a crank mechanism connected with a piston rod of said piston via an oil seal; a crank chamber for housing therein said crank mechanism and communicating with said cylinder via said oil seal, said apparatus comprising:

a cross guide formed at one end of said piston rod remote from said piston, and pivotally connected with a connecting rod of said crank mechanism for converting rotational motion of said crank mechanism into linear reciprocal motion of said piston;

a recessed guide formed in said crank chamber for supporting and guiding said cross guide in Linear motion, said recessed guide having a piston rod bore through which said piston rod penetrates; and an oil repellent member formed as a terminal end of said recessed guide for preventing accumulation of lubrication oil on said terminal end.

8. An apparatus for compressing/expanding a working gas (compression/expansion apparatus), including: a cylinder; a piston for compressing/expanding said working gas in a working space (front space) of said cylinder; a crank mechanism connected with a piston rod of said piston via an oil seal; a crank chamber for housing therein said crank mechanism and communicating with said cylinder via said oil seal, said apparatus comprising:

a cross guide formed at one end of said piston rod remote from said piston, and pivotally connected with a connecting rod or said crank mechanism for converting rotational motion of said crank mechanism into linear reciprocal motion of said piston;

a recessed guide formed in said crank chamber for supporting and guiding said cross guide in linear motion, said recessed guide having a piston rod bore through which said piston rod penetrates; and a groove for returning lubrication oil accumulated in said recessed guide, said groove formed in said recessed guide and increasing in depth from a terminal end to an open end of said recessed guide.

9. An apparatus as claimed in claim 8, further comprising oil repellent member formed at said terminal end of said recessed guide.

* * * * *